US005781874A

United States Patent [19]

Troppman et al.

[11] Patent Number: 5,781,874

[45] Date of Patent: Jul. 14, 1998

[54] CONTROL SYSTEM FOR A COMPACTION ROLLER VIBRATORY MECHANISM

[75] Inventors: G. Louis Troppman, Maugansville, Md.; Kenneth E. Gasper, Chambersburg, Pa.

[73] Assignee: Ingersoll-Rand Company, Woodcliff Lake, N.J.

[21] Appl. No.: 563,693

[22] Filed: Nov. 28, 1995

[51] Int. Cl.[6] ..... E01C 19/28

[52] U.S. Cl. ..... 701/50; 404/117; 73/594

[58] Field of Search ..... 364/424.07, 507; 404/103, 133.5, 117; 73/84, 594, 573; 701/50

[56] References Cited

U.S. PATENT DOCUMENTS

| | | | |
|---|---|---|---|
| 3,599,543 | 8/1971 | Kerridge | 404/117 |
| 3,814,532 | 6/1974 | Barrett et al. | 404/117 |
| 4,103,554 | 8/1978 | Thurner | 73/573 |
| 4,127,351 | 11/1978 | Vural | 404/113.05 |
| 4,149,253 | 4/1979 | Paar et al. | 404/117 |
| 4,348,901 | 9/1982 | Vural et al. | 73/594 |
| 4,734,846 | 3/1988 | Konig | 404/117 |
| 5,164,641 | 11/1992 | Quibel et al. | 364/505 |
| 5,493,494 | 2/1996 | Henderson | 364/424.07 |
| 5,618,133 | 4/1997 | Mitsui et al. | 404/117 |

*Primary Examiner*—Gary Chin

*Attorney, Agent, or Firm*—John J. Selko

[57] ABSTRACT

A vibratory compactor includes front and rear frame portions driven by a first hydraulic motor and a vibration mechanism on at least one of the frame portions also driven by a second hydraulic motor. A first sensor on the vehicle senses movement of a member on said vehicle driven by said first hydraulic motor, and sends corresponding signals to a microcontroller on the vehicle. A timing device sends timing signals to the microcontroller, which is programmed to convert the movement signals and timing signals to indicate longitudinal speed of travel of the vehicle. The microcontroller automatically turns a vibration means on the vehicle on or off depending on the speed of the vehicle. A second sensor on the vehicle sends a signal to the microcontroller indicating a reverse direction of travel of the vehicle. The microcontroller automatically coincides the direction of motion of the vibration means with the direction of travel of the vehicle.

11 Claims, 4 Drawing Sheets

CONTROL SYSTEM FOR A COMPACTION ROLLER VIBRATORY MECHANISM

BACKGROUND OF THE INVENTION

This invention relates generally to a system for controlling the on/off point and the direction of rotation of a vibratory device in a vibratory compactor, and more particularly to a system utilizing signals from speed sensing and direction sensing devices on the compactor to automatically turn the vibratory device on and off at a given speed and to automatically set the direction of rotation of the vibratory device depending upon the forward or reverse direction of movement of the compactor.

Prior art devices for controlling the on/off point and the direction of rotation of a vibratory device use mechanical connections, such as cables extending between the vehicle's propulsion lever and switches and other activating devices. Over time, mechanical connections become worn and out of adjustment, causing improper operation that leads to inconsistent compaction.

The foregoing illustrates limitations known to exist in present vibratory control systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a system for controlling a vibratory mechanism on a vibratory compaction vehicle comprising: a first vehicle frame portion mounted on a front driving member rotatably connected to a first transverse axle; a second vehicle frame portion mounted on a rear driving member rotatably connected to a second transverse axle parallel to said first axle, said first and second frame portions being connected together; propulsion means for propelling said vehicle including a first hydraulic motor means for rotating one of said driving members; vibration means mounted on said one driving member for causing vibratory impacts to be transmitted by said one driving member to material to be compacted thereunder; means for determining a longitudinal speed of movement of said vehicle; and means for turning said vibratory mechanism on and off, when said horizontal speed is within a preselected range.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 2:
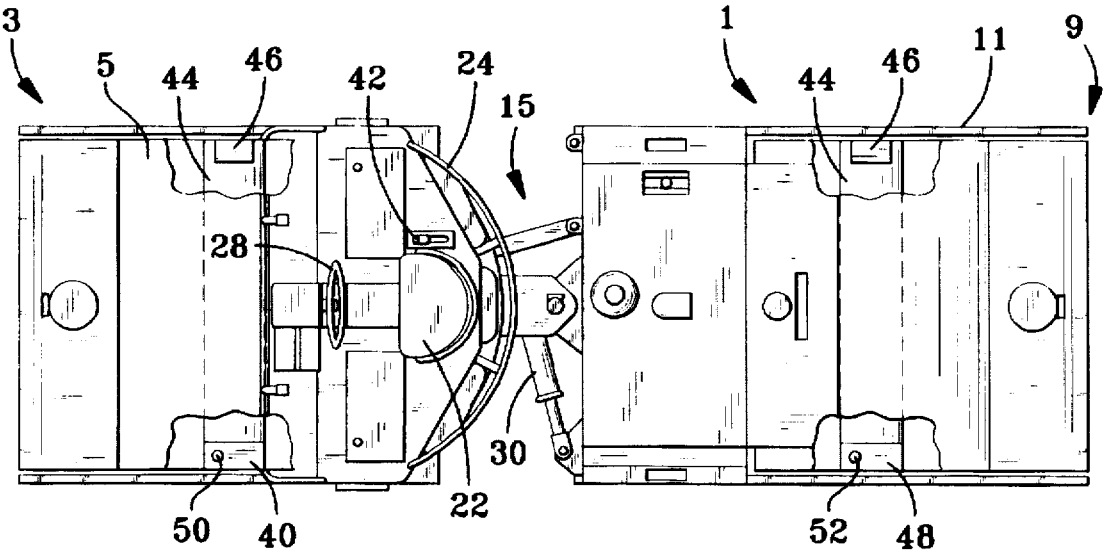
FIG. 2 is a schematic, partly cross-sectional plan view of the compactor of this invention.
Figure 1:
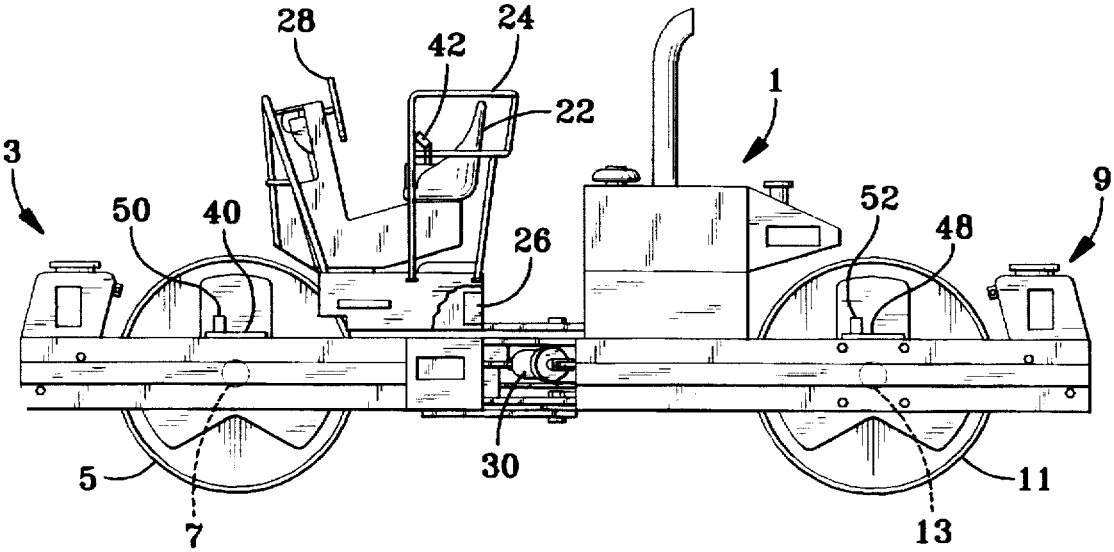
FIG. 1 is a schematic, partly cross-sectional elevational side view of the compactor of this invention.

FIGS. 1 and 2 show a conventional mobile asphalt compacting vehicle 1 having a first vehicle frame portion 3 mounted on a steel drum front driving member 5, which is rotatably connected to a first transverse axle 7, as is well known. A second vehicle frame portion 9 is mounted on a rear steel drum driving member 11, which is also rotatably connected to a second transverse axle 13 parallel to axle 7. First and second frame portions are connected to each other by an articulated joint 15, as is well known, although a rigid connection can also be used. Carried on first frame portion 3 is an operator station of conventional design, including a seat 22, a safety rail 24, and a steering wheel 28, whereby steering mechanism 30 is actuated. Mounted on vehicle 1 is a vibration control microprocessor 26, as described hereinafter.

Propulsion means for propelling the vehicle 1 includes first hydraulic motor 40 for rotating front driving member 5. Motor 40 and its operative connection to driving member 5 are conventional and well known. Propulsion lever 42 is used by a machine operator (not shown) to control the forward or reverse direction of the vehicle, as well as the speed in either forward or reverse, as is conventional and well known.

Mounted on front driving member 5 is a conventional rotary vibration means 44 for causing vibratory impacts to be transmitted by front driving member 5 to material to be compacted thereunder. Vibration means 44 is driven by a second hydraulic motor 46. Motor 46 and its operative connection to driving member 5 are conventional and well known. Motor 46 can be operated in a forward or a reverse direction to cause the eccentrically mounted vibratory means 44 to operate in a forward or reverse direction, corresponding to the direction of travel of vehicle 1, as is well known. We prefer to operate motor 46 and vibration means 44 in the same direction as the movement of the vehicle 1. Thus, when the vehicle 1 is moving forward, the vibration means is rotated in a forward direction, and when the vehicle 1 is moving rearwardly, the vibration means 44 is rotated in a reverse direction. A vibratory compactor that coincides the direction of vehicle movement and direction of vibratory rotation exhibits reduced tractive effort to ride up onto a mat of material to be compacted, providing better compaction.

We have shown a double drum compactor, but this invention will work with a single drum compactor. With a double drum compactor, a third hydraulic motor 48 rotates rear driving member 11. It is also optional to provide a vibration means 44, 46 on either or both front and rear driving members 5, 11. For a double drum compactor, we prefer a vibration means 44 on both front and rear driving members 5,11.

Figure 4:
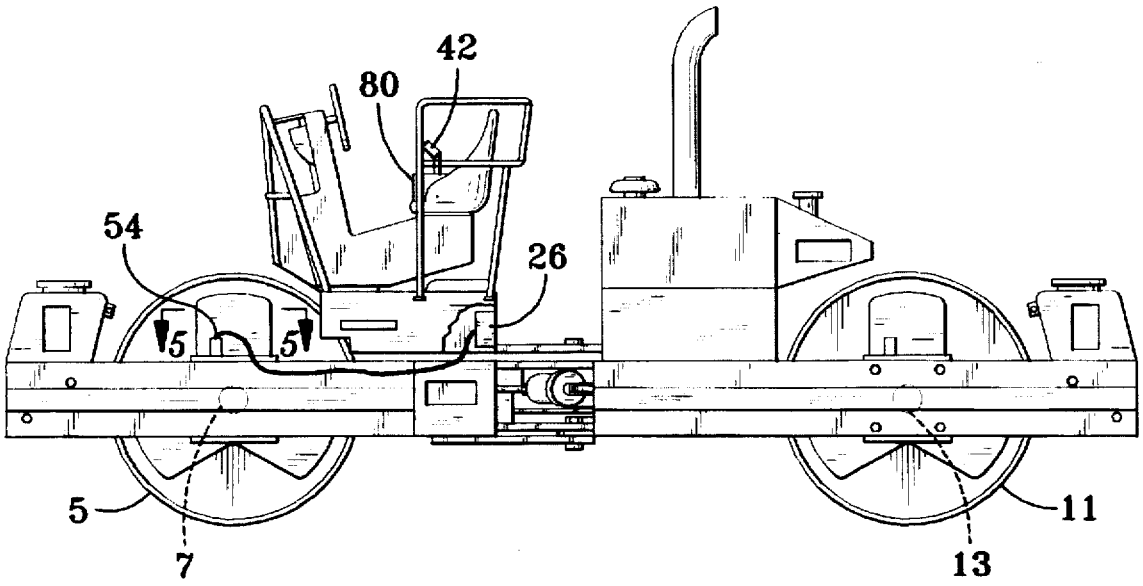
FIG. 4 is a schematic elevational view showing a movement sensing arrangement for a compactor of this invention.
Figure 5:
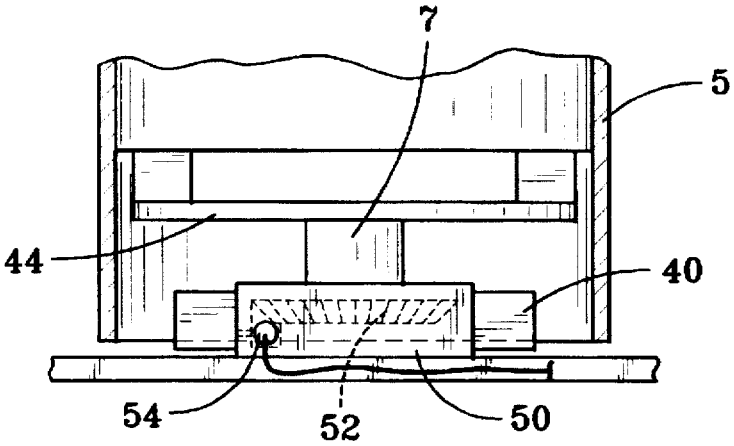
FIG. 5 is a view along 5—5 of FIG. 4.

Referring to FIGS. 4 and 5, means for controlling the on/off point of a vibration means 44 in vehicle 1 will now be described. Hydraulic motor 40 interacts with a speed reducer 50 having a plurality of gear teeth 52 rotating about axle 7 of drum 5. A sensing device 54 induces a magnetic field through which gear teeth 52 move. As each gear tooth 52 and its adjacent gap moves through the magnetic field, sensing device 54 detects an intermittent change in magnetic field flux as a plurality of intermittent events herein termed "pulses", caused by the presence and absence of the metal gear tooth. These "pulses" are transmitted as a plurality of intermittent electrical signals to microcontroller 26.

Figure 6:
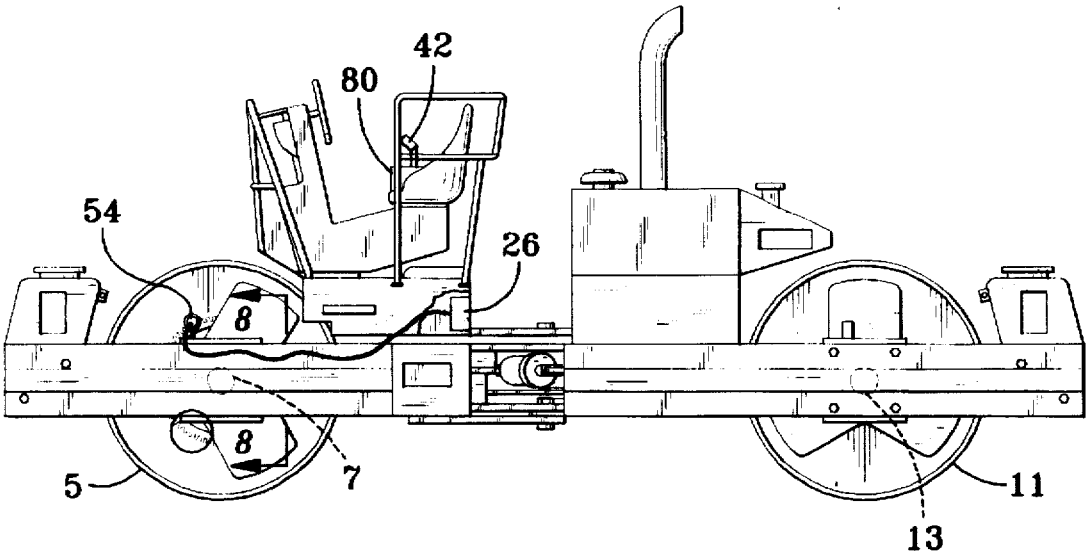
FIG. 6 is an alternate embodiment of a movement sensing arrangement for the compactor of this invention.
Figure 7:
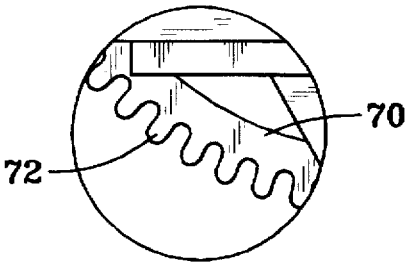
FIG. 7 is an expanded view of the circled area of FIG. 6.
Figure 8:
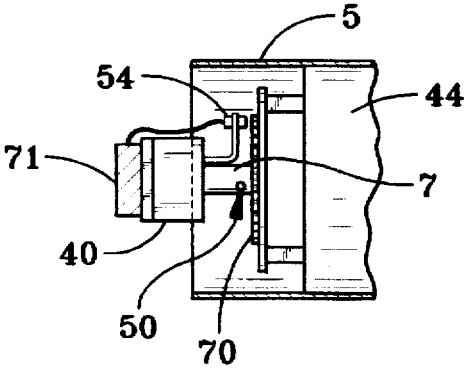
FIG. 8 is a view along 8—8 of FIG. 6.

Referring to FIGS. 6, 7 and 8, an alternate embodiment of means for controlling the on/off point of a vibration means 44 in vehicle 1 will now be described. An annular pick-up ring 70 is mounted adjacent speed reducer 50 on axle 7, for rotating with axle 7. Axle 7 is supported by frame member portion 71, as is conventional. Ring 70 has a plurality of teeth 72 formed on its outside diameter. Sensing device 54 induces the magnetic field through which the teeth 72 move. As each gear tooth 72 and its adjacent gap moves through the magnetic field, sensing device 54 detects an intermittent change in magnetic field flux as a plurality of intermittent "pulses", caused by the presence and absence of the metal gear tooth. These "pulses" are transmitted as a plurality of intermittent electrical signals to microcontroller 26.

In either embodiment, simultaneously with the action of sensing device 54, a timing clock 60 (FIG. 3) transmits a timing signal to microcontroller 26. Microcontroller 26 includes a microchip, programmed to convert the "pulsed" electrical signal and the timing signal into a number herein called "Sensor Input Frequency", stated in cycles per second (hereinafter called "Hz"). Microcontroller 26 relates the Sensor Input Frequency number to a vehicle longitudinal speed in miles per hour. Examples I–IV show the algorithm used by microprocessor 26 to perform the calculations herein described for various diameters of drum 5.

Other types of speed determining devices can be used, such as radar impinging on the ground, or other optical devices to sense the "pulses" of moving teeth 52, 72, or other moving elements on vehicle 1.

EXAMPLE I

DD-65 Machine Speed vs. Sensor Frequency

Drum Dia.: 41.3 in.
$\pi$=C/D C=$\pi$D
Sensor Input Freq. (Hz)=(a mi./hr.)(5280 ft./mi.) (12 in./ft.) (1 hr./60 min.) (1 drum rev./$\pi$[41.3 in.]) (1 min./60 sec.) (1 motor rev./drum rev.) (56 pulses/motor rev.)
Sensor Input Frequency (Hz)=(a mi./hr.) (7.60)

| Machine Travel Speed (mi./hr.) | Sensor Input Frequency (Hz) |
|---|---|
| .2 | 1.52 |
| .3 | 2.28 |
| .4 | 3.04 |
| .5 | 3.80 |
| .6 | 4.56 |
| .7 | 5.32 |
| .8 | 6.08 |
| .9 | 6.84 |
| 1.0 | 7.60 |

EXAMPLE II

DD-130 Machine Speed vs. Sensor Frequency

Drum Dia.: 1400 mm (55.1 in.)
$\pi$=C/D C=$\pi$D
Sensor Input Freq. (Hz)=(a mi./hr.) (5280 ft./mi.) (12 in./ft.) (1 hr./60 min.) (1 drum rev./$\pi$[55.1 in.]) (1 min./60 sec.) (1 motor rev./drum rev.) (60 pulses/motor rev.)
Sensor Input Frequency (Hz)=(a mi./hr.) (6.10)

| Machine Travel Speed (mi./hr.) | Sensor Input Frequency (Hz) |
|---|---|
| .2 | 1.22 |
| .3 | 1.83 |
| .4 | 2.44 |
| .5 | 3.05 |
| .6 | 3.66 |
| .7 | 4.27 |
| .8 | 4.88 |
| .9 | 5.49 |
| 1.0 | 6.10 |

EXAMPLE III

DD-90 Machine Speed vs. Sensor Frequency

Drum Dia.: 48 in.
$\pi$=C/D C=$\pi$D
Sensor Input Freq. (Hz)=(a mi./hr.) (5280 ft./mi.) (12 in./ft.) (1 hr./60 min.) (1 drum rev./$\pi$[48 in.]) (1 min./60 sec.) (34.62 motor rev./drum rev.) (28 pulses/motor rev.)
Sensor Input Frequency (Hz)=(a mi./hr.) (113.14)

| Machine Travel Speed (mi./hr.) | Sensor Input Frequency (Hz) |
|---|---|
| .2 | 22.62 |
| .3 | 33.94 |
| .4 | 45.26 |
| .5 | 56.57 |
| .6 | 67.88 |
| .7 | 79.20 |
| .8 | 90.51 |
| .9 | 101.82 |
| 1.0 | 113.14 |

EXAMPLE IV

DD-110 Machine Speed vs. Sensor Frequency

Drum Dia.: 54 in.
$\pi$=C/D C=$\pi$D
Sensor Input Freq. (Hz)=(a mi./hr.) (5280 ft./mi.) (12 in./ft.) (1 hr./60 min.) (1 drum rev./$\pi$[54 in.]) (1 min./60 sec.) (34.62 motor rev./drum rev.) (28 pulses/motor rev.)
Sensor Input Frequency (Hz)=(a mi./hr.) (100.57)

| Machine Travel Speed (mi./hr.) | Sensor Input Frequency (Hz) |
|---|---|
| .2 | 20.1 |
| .3 | 30.2 |
| .4 | 40.2 |
| .5 | 50.3 |
| .6 | 60.3 |
| .7 | 70.4 |
| .8 | 80.5 |
| .9 | 90.5 |
| 1.0 | 100.6 |

Microcontroller 26 is programmed to receive an input signal from an operator selector switch 64 (FIG. 3), which signal selects a machine travel speed range wherein the microcontroller will activate vibration devices 44. When the machine travel speed is within the range, a vibration device activating signal is generated by microcontroller 26 and transmitted to electro-hydraulic valve means 66, 68 to activate vibration device 44 on drums 5, 11, either in the forward or reverse direction as described hereinafter.

Means for sensing the direction of movement of vehicle 1 and for thereafter controlling the direction of rotation of motor 48 in vibration means 44 will now be described. A transducer switch 80 is operably connected to propulsion leyer 42. Switch 80 is a normally open switch, and thus will continuously permit the microcontroller 26 to indicate a forward direction to vibration device 44. Switch 80 is only closed when the propulsion lever 42 is in the reverse position, and in the closed position, switch 80 generates a reverse direction electrical signal. In the forward direction, microcontroller 26 transmits a first vibration activation signal to a first electro-hydraulic valve 66 that operates motor 46 of vibration means 44 on drums 5, 11 in a forward direction. Reverse direction signal causes microcontroller 26 to transmit a second vibration activation signal to a second electro-hydraulic valve 68 that operates motor 46 of vibration means 44 on drums 5, 11 in a reverse direction. It can be understood that this automatic selection of direction of operation of motor can be eliminated, with such signals being manually input, and only the start/stop points being automatic. We prefer the automatic directional operation together with the automatic start/stop.

Figure 3:
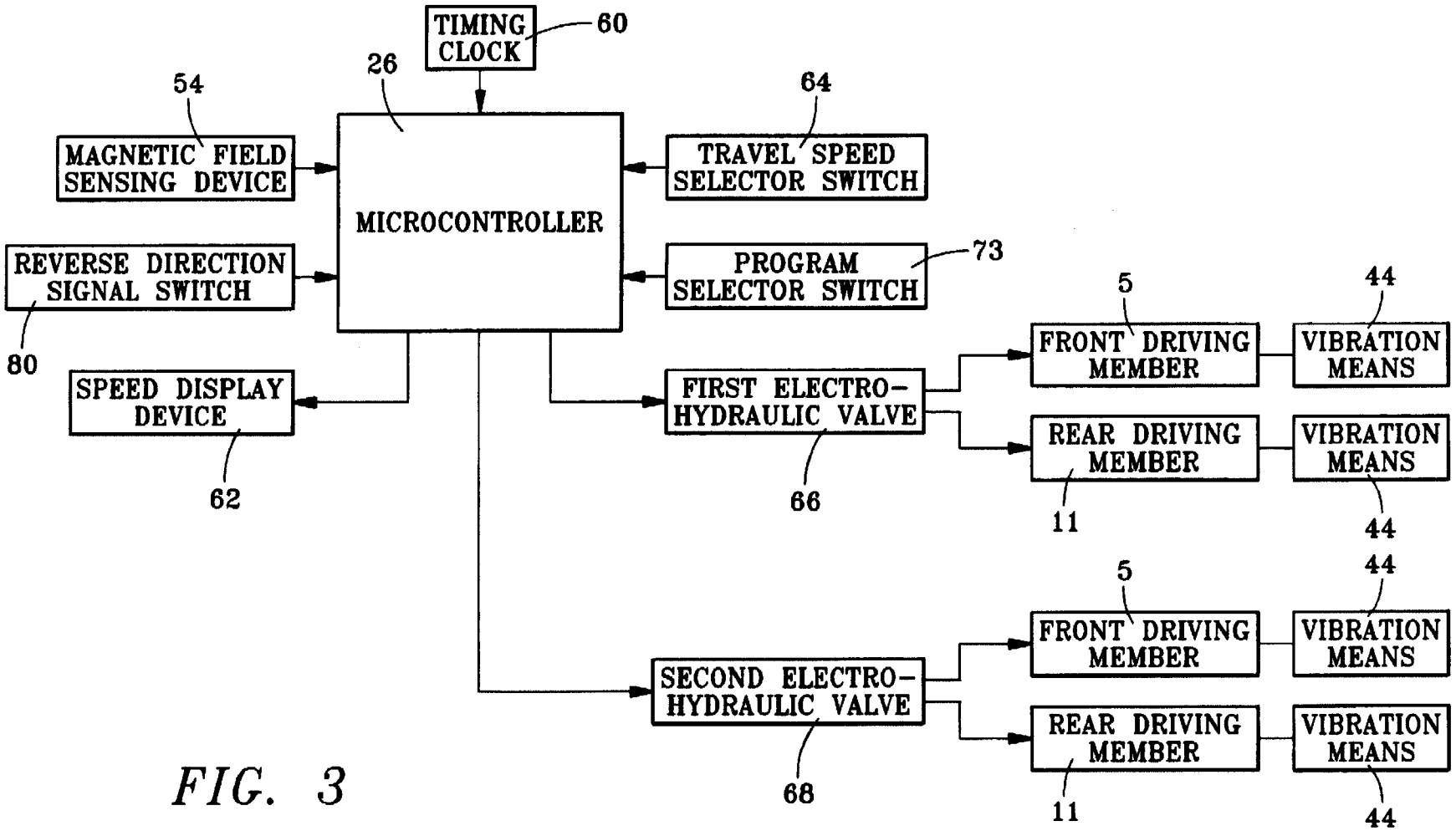
FIG. 3 is a block diagram of the signal flow of the present invention in accordance with which signals are generated and processed, to control a vibratory device based upon speed and direction of movement of the compactor of this invention.

FIG. 3 shows a schematic block diagram of the signal flow of the present invention in accordance with which signals are generated and processed, to activate vibration means 44. FIG. 3 shows an arrangement having a motor 40, 48 on members 5, 11, respectively, plus a vibration means 44 on front and rear driving members 5, 11. Microcontroller 26 can include a plurality of microchips, each microchip programmed for one drum size, or, alternatively, a single microchip can be programmed with a plurality of programs for various size drums. Each program can be selectively activated by a signal manually input from a machine model selector switch 72. Optionally, microcontroller 26 can generate a speed display signal that is transmitted to a speed display device 62 visible to an operator.

Techniques for programming microchips described herein are conventional and well known. The major elements of this apparatus are readily available.

For motor 40, we prefer a motor from Sauer Sundstrand Company, series 90 designation or a motor from Poclain Hydraulics, Inc., designation T36. For motor 46, we prefer a series 90 motor from Sauer Sundstrand Company. For speed sensor 54, we prefer speed sensor part number 727573-02 from the Electro Corporation. For microcontroller 26, we prefer a Motorola Corporation microcontroller, part number MC68HC7057J2.

Having described the invention, what is claimed is:

1. A system for controlling a vibratory mechanism on a vibratory compaction vehicle comprising:

(a) a first vehicle frame portion mounted on a front driving member rotatably connected to a first transverse axle;

(b) a second vehicle frame portion mounted on a rear driving member rotatably connected to a second transverse axle parallel to said first axle, said first and second frame portions being connected together;

(c) propulsion means for propelling said vehicle including a first hydraulic motor means for rotating one of said driving members;

(d) vibration means mounted on said one driving member for causing vibratory impacts to be transmitted by said one driving member to material to be compacted thereunder;

(e) means for determining a longitudinal speed of movement of said vehicle; and (f) means for automatically turning said vibration means on, when said longitudinal speed is within a preselected range.

2. The system of claim 1 wherein said longitudinal speed determining means further comprises:

(a) movement sensing means for sensing a plurality of intermittent pulses associated with movement of a member of said vehicle, said member being driven by said first hydraulic motor, and for generating a plurality of intermittent electrical signals corresponding to the number of said pulses;

(b) clock means for generating a timing electrical signal;

(d) selector switch means for transmitting a signal which indicates a preselected machine travel speed range; and (c) microcontroller means electrically connected to said speed sensing means, said clock means and said selector switch means, responsive to said intermittent electrical signals, said timing signal, and said speed range selection signal, said microcontroller means including:

(i) means for converting said intermittent electrical signals and timing signal to said longitudinal speed of travel; and (ii) means for starting said vibration means when said longitudinal speed is in a forward travel direction and within the preselected speed range; and (iii) said vibration means being operable in a first, forward direction coinciding with said forward travel direction.

3. The system of claim 2 wherein said first frame portion is connected to said second frame portion through an articulated joint.

4. The system of claim 3 wherein said front driving member includes a planar drum.

5. The system of claim 4 wherein said rear driving member includes a planar drum.

6. The system of claim 5 further comprising:

(a) a second hydraulic motor means for rotating said rear driving member; and b. a second vibration means mounted on said rear driving member for causing vibratory impacts to be transmitted by said rear driving member to material to be compacted thereunder, said second vibration means being electrically connected to said microcontroller means, for starting said second vibration means when said longitudinal speed is within a preselected speed range.

7. The system of claim 5 further comprising:

(a) a reverse direction sensing means for sensing a reverse direction of travel of said vehicle and for generating a reverse direction indicating signal;

(b) said microcontroller means electrically connected to said direction sensing means, responsive to said reverse direction indicating electrical signal;

(c) said microcontroller operably connected to said vibration means to start said vibration means; and (d) said vibration means being operable in a second, reverse direction corresponding to said reverse travel direction detected by said direction sensing means.

8. The system of claim 7 further comprising:

(a) said microcontroller means including means for indicating said longitudinal speed in a speed indicating device.

9. The system of claim 2 wherein said movement sensing means includes:

(a) means for inducing an electromagnetic field around said moving member of said vehicle being driven by said first hydraulic motor; and (b) means for detecting intermittent changes in said magnetic field caused by said movement of said moving member.

10. The system of claim 9 wherein said moving member is a speed reducing device rotatable about said axle, said speed reducing device having a plurality of gear teeth moving through said electromagnetic field and causing said intermittent changes thereof.

11. The system of claim 9 wherein said moving member is an annular indicator ring rotatable about said axle, said indicator ring having a plurality of gear teeth moving through said electromagnetic field and causing said intermittent changes thereof.

* * * * *